US006557346B1

(12) United States Patent
Oetting et al.

(10) Patent No.: US 6,557,346 B1
(45) Date of Patent: May 6, 2003

(54) GAS CONDUCTING DEVICE

(75) Inventors: Hermann Oetting, Braunschweig (DE); Ekkehard Bielass, Lippstadt (DE)

(73) Assignee: A. Kayser Automotive Systems GmbH, Einbeck (DE)

( * ) Notice: Subject to any disclaimer, the term of this patent is extended or adjusted under 35 U.S.C. 154(b) by 0 days.

(21) Appl. No.: 09/889,335

(22) PCT Filed: Feb. 1, 2000

(86) PCT No.: PCT/EP00/00778

§ 371 (c)(1),
(2), (4) Date: Oct. 19, 2001

(87) PCT Pub. No.: WO00/46533

PCT Pub. Date: Aug. 10, 2000

(30) Foreign Application Priority Data

Feb. 2, 1999 (DE) ..... 199 04 190
Jun. 2, 1999 (DE) ..... 199 25 242

(51) Int. Cl.[7] ..... F02B 33/44
(52) U.S. Cl. ..... 60/605.1; 60/602
(58) Field of Search ..... 60/605.1, 611, 60/605.2, 602

(56) References Cited

U.S. PATENT DOCUMENTS 4,356,695 A * 11/1982 Sumi et al. ..... 60/602
4,437,311 A * 3/1984 Iwamoto et al. ..... 60/602
4,870,822 A 10/1989 Kamimaru ..... 60/600
5,255,659 A 10/1993 Choma ..... 123/568
6,018,949 A * 2/2000 Brosecke et al. ..... 60/602
6,272,860 B1 * 8/2001 Klein et al. ..... 60/602
6,293,266 B1 9/2001 Oetting ..... 123/568.21
6,318,085 B1 * 11/2001 Torno et al. ..... 60/611

FOREIGN PATENT DOCUMENTS

| | | |
|---|---|---|
| DE | 3611869 | 10/1987 |
| DE | 3807998 | 9/1988 |
| DE | 4410487 | 3/1995 |
| DE | 19639146 | 11/1997 |
| WO | WO 9854460 | 12/1998 |

* cited by examiner

*Primary Examiner*—Hoang Nguyen
(74) *Attorney, Agent, or Firm*—Nelson Mullins Riley & Scarborough, LLP

(57) ABSTRACT

The invention relates to a gas conducting device for internal combustion engines, notably motor vehicle engines, comprising a pressure line (5), a fresh-gas line (2) supplying fresh gas, a discharge line (4) and an orifice (1) which opens into the fresh gas line (2) and the discharge line (4). At least the pressure line (5) and the orifice (1) are connected via a control element (60–69) for the metered addition of gas. A compensating unit (61; 61A; 62; 62A; 63; 80; 81; 82; 84; 85; 86; 89) is provided for so as to compensate forces which act on the control element (60–69) as a result of a pressure difference ($p_5$–$p_3$; $p_3$–$p_2$) between the gas pressure on the compressed gas side ($p_5$; $p_3$) and the fresh gas side ($p_3$; $p_2$).

22 Claims, 15 Drawing Sheets

GAS CONDUCTING DEVICE

The invention relates to a gas-conducting device having pressure compensation as described in claim 1 and to the use of such a gas-conducting device as an exhaust-gas-recirculation valve and as an air-conducting means for an internal combustion engine having a charge-air device.

Spark-ignition and diesel engines, in particular those of motor vehicles, are normally provided with gas-conducting devices, in particular exhaust-gas-recirculation valves (EGR valves). They partly admix exhaust gas with the fresh intake gas in order to reduce the NOx emission and also to improve the fuel consumption and reduce the generation of noise. Furthermore, there are air-conducting devices, in particular in connection with charge-air devices of internal combustion engines.

Such gas-conducting devices comprise metering elements or control elements, with which the quantity of conducted or recirculated gas can be set as a function of the operating point. Too little gas recirculation would fail to have the desired effects; too much gas recirculation, in the case of exhaust-gas recirculation in spark-ignition engines, would lead to malfunctions or to an undesirable increase in HC or even CO emissions and, in diesel engines, would lead to an undesirable increase in the particle emissions; and too much air recirculation would make the desired charge state unattainable.

Such control elements are as a rule valves which can be closed completely and which are set by a vacuum diaphragm or a servomotor or a proportional magnet working against a spring, which in turn are actuated via a timing valve or a relay from the control unit of the engine. The information used for this purpose in the control unit generally concerns the load and speed of the engine and the air quantity drawn in. To improve the functioning, the feedback of the opening travel via a displacement measuring system is also applied.

Acting on the gas-conducting devices is a pressure gradient, which as a rule exists between the pipe systems of the engine which are connected to them. It poses a problem for the actuation of the metering element of the gas-conducting device inasmuch as it generally attempts to move the metering element in the direction in which the conducted or recirculated gas also flows.

It is an object of the invention to provide a gas-conducting device in which the actuation of the valve is as far as possible independent of the aforesaid pressure fluctuations acting on the gas-conducting device.

The object is achieved by a gas-conducting device having the features specified in claim 1.

According to the invention, a gas-conducting device for internal combustion engines, in particular motor vehicle engines, comprises a pressure duct, a fresh-gas duct feeding fresh gas, an outlet duct and an orifice opening into the fresh-gas duct and the outlet duct, at least the pressure duct and the orifice being connected to one another via a control element for metering or controlling gas, in particular air or exhaust gas, and a compensating device being provided in order to compensate for forces which act on the control element on account of a pressure difference between gas pressures on the pressure-gas side and gas pressures on the fresh-gas side. The aforesaid effect of the pressure gradient is therefore minimized and preferably completely compensated for by the provision according to the invention of the compensating device. Consequently, the invention enables, in particular, an actuating device of the control element to be dimensioned so as to be correspondingly smaller, resulting in a saving in space and weight, lower power consumption and less self-heating. The pressure gradient of the gas pressure across the control element, on account of this compensating device, cannot lead to a force component which acts in the direction of undesirable opening or closing of the control element, as a result of which the desired control of the gas quantity fed through is considerably improved.

In a preferred embodiment of the invention, one side of the compensating device is acted upon with the gas pressure on the pressure-gas side and the other side is acted upon with the gas pressure on the fresh-gas side. The resulting pressure difference via the compensating device results in a force component which is opposed to the force component to be compensated, has the same magnitude and therefore effects the balancing of the two force components.

The compensating device may advantageously be provided as a butterfly valve, a double, ball, cone or cylinder valve in the control element.

In a further preferred embodiment, the control element comprises a valve rod and a valve disk secured thereto and having a gas-pressure-effective area, so that a valve-disk force acts on the valve disk, this valve-disk force being equal to the product of the gas-pressure-effective area and the pressure difference. The compensating device comprises at least one piston, one diaphragm and/or one bellows, which is secured to the valve rod and on whose gas-pressure-effective area the pressure difference acts, so that a compensating force which compensates for the valve-disk force acts on the valve rod.

In a further preferred embodiment, the control element is actuable by a mechanical, pneumatic, hydraulic, magnetic or electric actuating device or servomotor, in particular an electric actuating magnet. The use of a magnet or proportional magnet has proved to be especially advantageous, since the opening or position of the control element can be set very quickly and accurately by such a magnet. Since the actuating force in a proportional magnet is determined approximately only by the current flowing through and not by the opening travel, a quick reaction to control signals is advantageously also possible.

In a further preferred embodiment, the compensating device comprises an inner valve which is provided in the control element.

A gas pressure in an inner-valve compensating space is advantageously controllable via the inner valve in combination with an opening gap between a piston of the compensating device and a guide sleeve of the piston, and the inner valve is actuable by an actuating device and/or an inner-valve actuating device. The selection of the diameter of the piston relative to that of the control element, for example of the main valve, also influences the matching of the inner valve to the opening gap between the piston and the guide sleeve.

In a further preferred embodiment, the compensating device acts on the control element via a kinematic transmission, in particular a lever transmission, in order to compensate for a difference between, on the one hand, areas of the control element which are effective for the gas pressure and, on the other hand, the compensating device. This transmission converts the force component produced by the compensating device to a magnitude which is suitable for compensating for the force to be compensated on the control element. This is especially advantageous if the areas of compensating device and control element which are effective for the gas pressures differ from one another.

In a preferred embodiment, the control element is prestressed in the closing direction by a spring action of a diaphragm or a bellows, in which case a spring, in particular, can be additionally provided for assisting the prestressing in order to produce an additional force component in the closing direction of the control element.

In a preferred embodiment of the invention, the compensating device and the control element are connected to one another in such a way as to be effective in terms of force and are controllable via the actuating device. In this way, the forces produced by the compensating device and by the actuating device can act jointly on the control element and can be suitably added to one another or can suitably compensate for one another in order to exert the desired net force or force component on the control element.

In a further embodiment, the control element has a device, e.g. a potentiometer, which at any time provides information on the respective opening cross section of the control element. Thus the control-element opening set by the actuating device can be compared with a desired opening.

According to a further aspect of the invention, the invention relates to the use of a gas-conducting device according to the invention as an air-conducting device in an internal combustion engine having a charge-air device, the pressure duct in this case being a fresh-air pressure duct which opens into a compressor outlet duct of a compressor of the charge-air device, the outlet duct being a compressor inlet duct of the compressor, and the fresh-gas duct being a fresh-air duct, and the control element being designed for metering air. Such use of the gas-conducting device as an air-conducting device also advantageously permits an air flow from the fresh-air duct into the fresh-air pressure duct through the control element, if a lower gas pressure prevails in the fresh-air pressure duct than in the fresh-air duct.

According to a further aspect of the invention, the invention relates to the use of the gas-conducting device according to the invention as an exhaust-gas-recirculation device for internal combustion engines,.the pressure duct in this case being an exhaust-gas duct and the control element being designed for metering exhaust gas from the exhaust-gas feed duct into the orifice and thus recirculating exhaust gas into a gas flow in the outlet duct, which opens into the gas feed of the internal combustion engine.

The invention is described in more detail below by way of example with reference to preferred embodiments. In the drawing.

Figure 1:
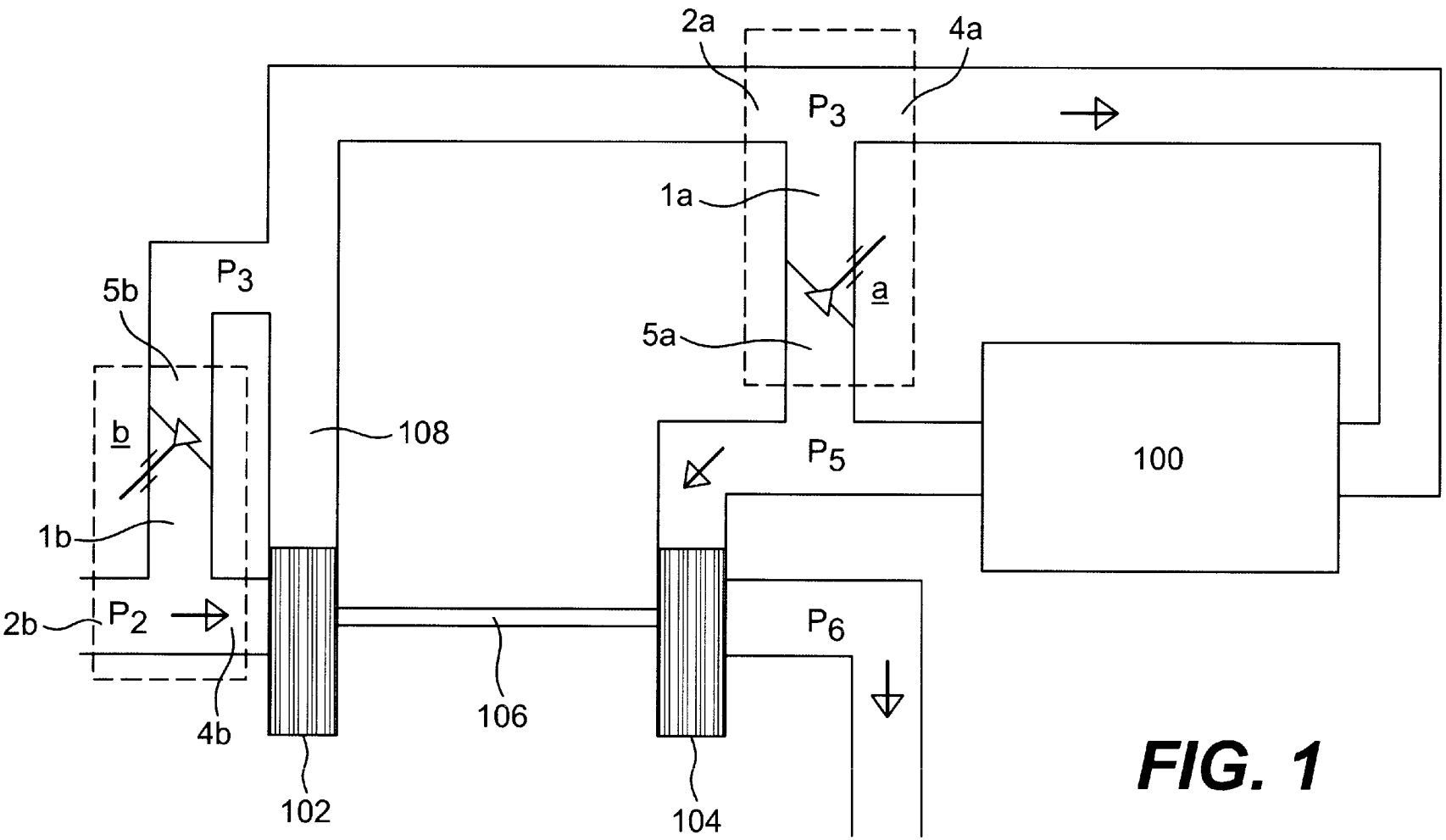
FIG. 1 shows a schematic representation of parts of a fresh-gas system and of the exhaust-gas system of an internal combustion engine, having a preferred arrangement of gas-conducting devices according to the invention, the reference numeral a designating an exhaust-gas-recirculation device and b an air-conducting device.

All identical or essentially identical features of the various embodiments are designated below with uniform reference numerals for reasons of simpler representation. The addition a to a reference numeral shows a preferred use of the gas-conducting device as an exhaust-gas-recirculation device; the addition b shows a preferred use as an air-conducting device in an internal combustion engine having a charge-air device.

FIG. 1 schematically shows parts of a fresh-gas and exhaust-gas system of an internal combustion engine and a preferred installation arrangement for an exhaust-gas-recirculation gas-conducting device (exhaust-gas-recirculation device) a and a fresh-gas-conducting gas-conditioning device (air-conducting device) b. The gas-conducting devices according to the invention which are arranged in such a way are shown by broken lines in FIG. 1.

In the case of the exhaust-gas-recirculating gas-conducting device a, the gas-conducting device is arranged between a fresh-air duct 2*a* conducting fresh air and an exhaust-gas duct 5*a* conducting exhaust gas and has an orifice 1*a* which opens into an outlet duct 4*a*. The outlet duct 4*a* feeds a gas flow, which contains fresh gas and exhaust gas metered by the exhaust-gas-recirculation device, to an engine unit 100. During operation of the internal combustion engine, a gas pressure $p_3$ prevails in the orifice 1*a* and a gas pressure $p_5$ prevails in the exhaust-gas duct 5*a*.

The remaining gas which is not recirculated can escape from the internal combustion engine through an exhaust-gas turbine 104. The exhaust-gas turbine 104 is connected via a turbocharger shaft 106 to a compressor 102, which pumps fresh air from a fresh-air duct 2*b* via a compressor inlet duct 4*b* into a compressor outlet duct 108. The fresh-air duct 2*b* and the compressor inlet duct 4*b* are connected to an orifice 1*b* of the air-conducting device b. A control element of the air-conducting device b separates the orifice 1*b* from a fresh-air pressure duct 5*b*. During operation, a gas pressure $p_3$ prevails in the fresh-air pressure duct 5*b* and a gas pressure $p_2$ prevails in the region of the orifice 1*b*.

Figure 2:
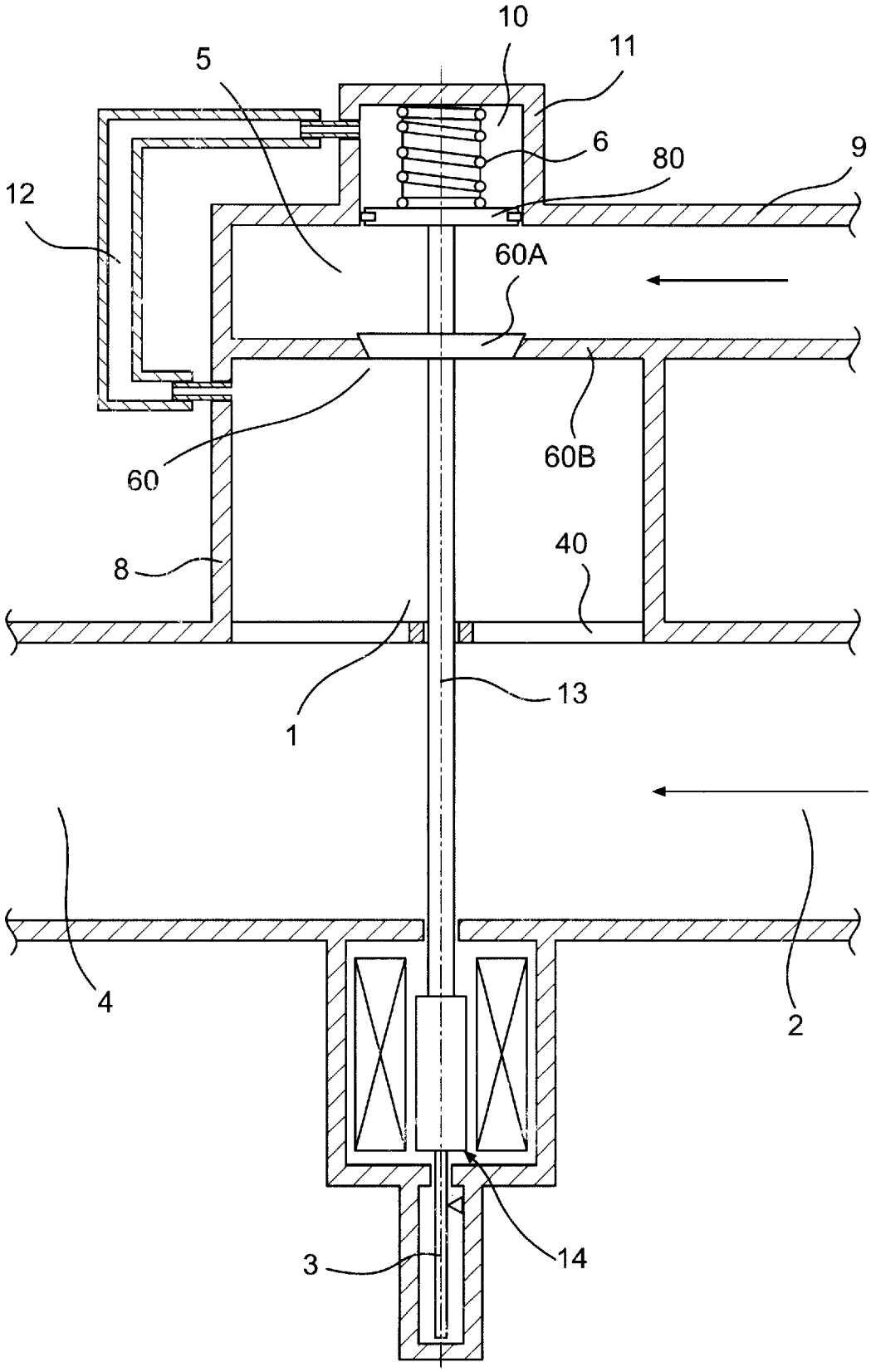
FIG. 2 shows a schematic cross-sectional representation of a gas-conducting device according to the invention having a pressure-compensation line.

FIG. 2 schematically shows a cross section of a first embodiment of the gas-conducting device according to the invention.

If this gas-conducting device is used as an exhaust-gas-recirculation device, exhaust gas is then fed to the exhaust-gas-recirculation device by means of a pressure duct 5 (exhaust-gas duct 5*a* in FIG. 1), one side of which leads into the main exhaust-gas flow of the engine. Fresh air is fed via the fresh-gas duct 2 (fresh-air duct 2*a* in FIG. 1), this fresh air being mixed with exhaust gas by metering exhaust gas from the pressure duct 5 by means of a main valve 60, to be described later. Fresh gas mixed with exhaust gas is accordingly conducted in a suitable manner in an outlet duct 4 which is connected to the gas feed of the engine unit.

If this gas feed is used as an air-conducting device, fresh air is fed via the fresh-gas duct 2 (fresh-air duct 2*b* in FIG. 1). In this case, the outlet duct 4 corresponds to the compressor inlet duct 4*b* shown in FIG. 1 and the pressure duct 5 corresponds to the fresh-air pressure duct 5*b* in FIG. 1.

The pressure duct 5 is connected to an orifice 1 via a valve or main valve 60, which consists of a valve disk 60A and a valve seat or wall 60B. The orifice 1 is connected to the fresh-gas duct 2 and the outlet duct 4, which passes on the fresh gases mixed with the recirculated gas.

A compensating space or piston space 10 for accommodating a compensating piston or balancing piston or piston 80 is provided in a top wall 9 of the pressure duct 5. The piston 80 bears at its periphery against a wall or side wall 11 and is connected to a top part of the wall 11 via a spring or helical spring 6. Via a line or balancing line 12, the piston space 10 is connected to the orifice 1 in such a way that the gas pressures in the piston space 10 and the orifice 1 can be rapidly balanced.

The piston 80 and valve disk 60A are connected to one another via a rod 13. Arranged on a side of the rod 13 opposite the piston 80 is an actuating device in the form of an electric magnet or proportional magnet 14, via which the main valve 60 can be controlled.

The gas pressure in the orifice 1 is under operating conditions $p_3$, or $p_2$, respectively. The gas pressure $p_5$ or $p_3$, respectively, is present in the pressure duct 5. At all the operating points of an aspirating engine which are relevant to exhaust-gas recirculation, $p_5>p_3$. A positive, i.e. an opposite, flushing gradient $p_5<p_3$ may possibly occur when the engine is supercharged mechanically or by a turbocharger.

If the gas-conducting device is used as an exhaust-gas-recirculation device, exhaust gas will therefore flow as a rule in the desired direction, i.e. from the pressure duct 5 (exhaust-gas duct 5*a*) in the direction of the orifice 1 when the main valve 60 is opened. In this case, the exhaust-gas quantity fed through essentially depends on the opening cross section of the main valve 60 and on the gas pressure gradient across the main valve 60, i.e. on the pressure difference $p_5-p_3$.

If the gas-conducting device is used as an air-conducting device, the main valve 60 is only opened in order to bring about a pressure balance between $p_2$ and $p_3$. This may also be desired in special cases when $p_2>p_3$.

The force acting in the rod 13 depends to a great extent on the pressure gradient $p_5-p_3$ or $p_3-p_2$, respectively, over the main valve 60. Without piston 80 and without the line 12, the force which would act in the rod 13 is the one which is obtained from the pressure gradient and a cross-sectional area or cross section $F_3$ of the valve disk 60A:

$$(p_5-p_3)\times F_3 \text{ or } (p_3-p_2)\times F_3, \text{ respectively.}$$

This force is compensated for by the piston 80, which has the same effective area or area $F_3$ of application for the gas pressure as the valve disk 60A. A force of the same magnitude which is opposed to the force on the valve disk 60A therefore acts on the piston 80.

The actuation of the main valve 60 of the gas-conducting device is preferably essentially achieved by the electric magnet or proportional magnet 14 via the rod 13, the force at the proportional magnet 14 depending only on the coil current and not on the position of the armature. Such an arrangement has the advantage that it can react quickly and can set a valve stroke or opening of the valve 60 very accurately. However, it is likewise possible to combine other actuating means of the main valve 60, such as mechanical, pneumatic, hydraulic and electromotive actuating means for example, with the pressure compensation described.

Further possibilities of compensating for the force acting in the rod 13 consist in using valves or main valves which open in the same or virtually the same manner and simultaneously or virtually simultaneously in the direction of the gas flow and in the opposite direction.

Figure 3:
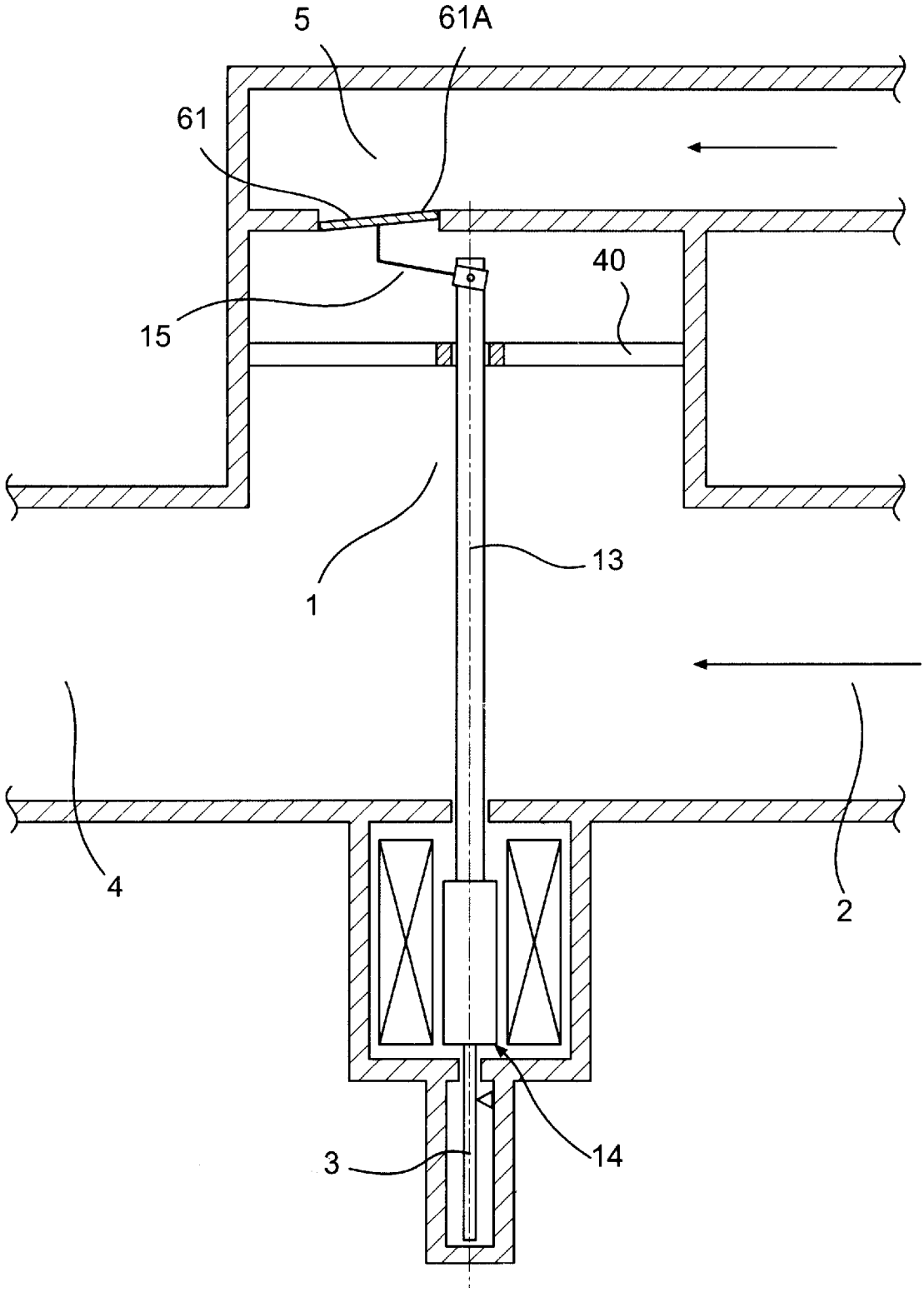
FIG. 3 shows a schematic cross-sectional representation of a further embodiment of the invention having a butterfly valve as control element.

A further embodiment of the invention based on such a pressure compensation is shown in FIG. 3. In this case, a butterfly valve 61A, which is connected to the rod 13 via a lever 15, can be used in the simplest manner as a metering or control element 61. It is advantageous in this case that the desired pressure compensation is possible in a very simple mechanical design. However, it is a disadvantage that the valve or main valve 61 formed with the butterfly valve 61A is not hermetically gastight in the closed state.

Figure 4:
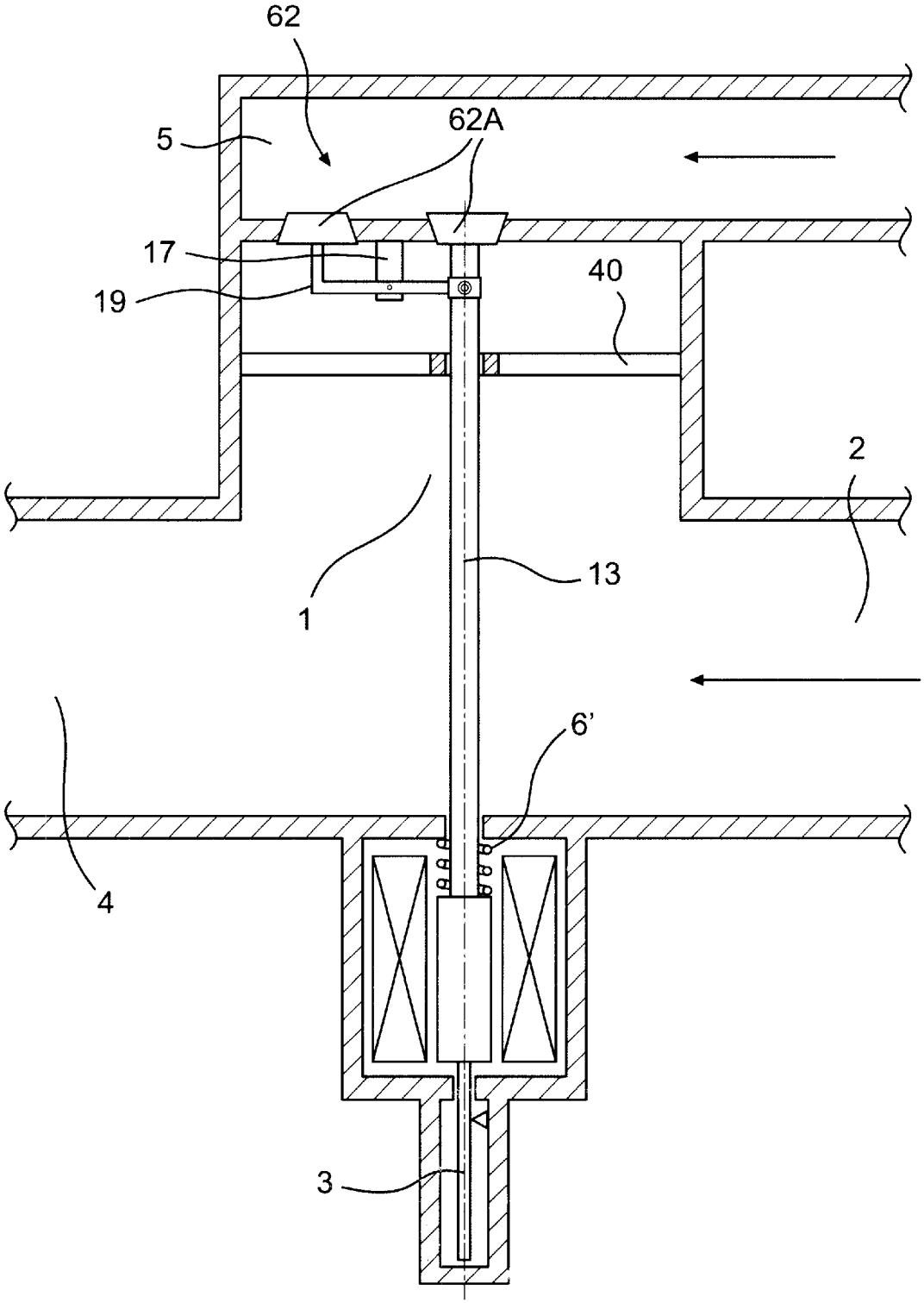
FIG. 4 shows a schematic cross-sectional representation of a further embodiment of the invention having two opposed valves.

FIG. 4 shows a further embodiment of the invention. Shown here is a further possibility for the pressure compensation, in which a valve disk 62A of a main valve 62 is directed on an arc of a circle in the gas-flow direction and a further valve disk 62A is directed linearly but in the opposite direction to the gas-flow direction. In this case, one of the valve disks 62A is secured to an L-shaped lever 19 which is connected to the rod 13 in a pivotable manner, the lever 19 being mounted in a pivotable manner at its center on a fixed wall projection 17. The other valve disk 62A is secured to the top end of the rod 13. The arrangement of the lever 19 and those areas of the valve disks 62A which are effective for the gas pressure are in this case selected in such a way that the forces acting on the rod 13 compensate for one another on account of the pressure gradient between the pressure duct 5 and the orifice 1. Instead of using a circular path and a linear valve-disk guide, two linear valve-disk guides or two circular-path guides are also possible.

Figure 5:
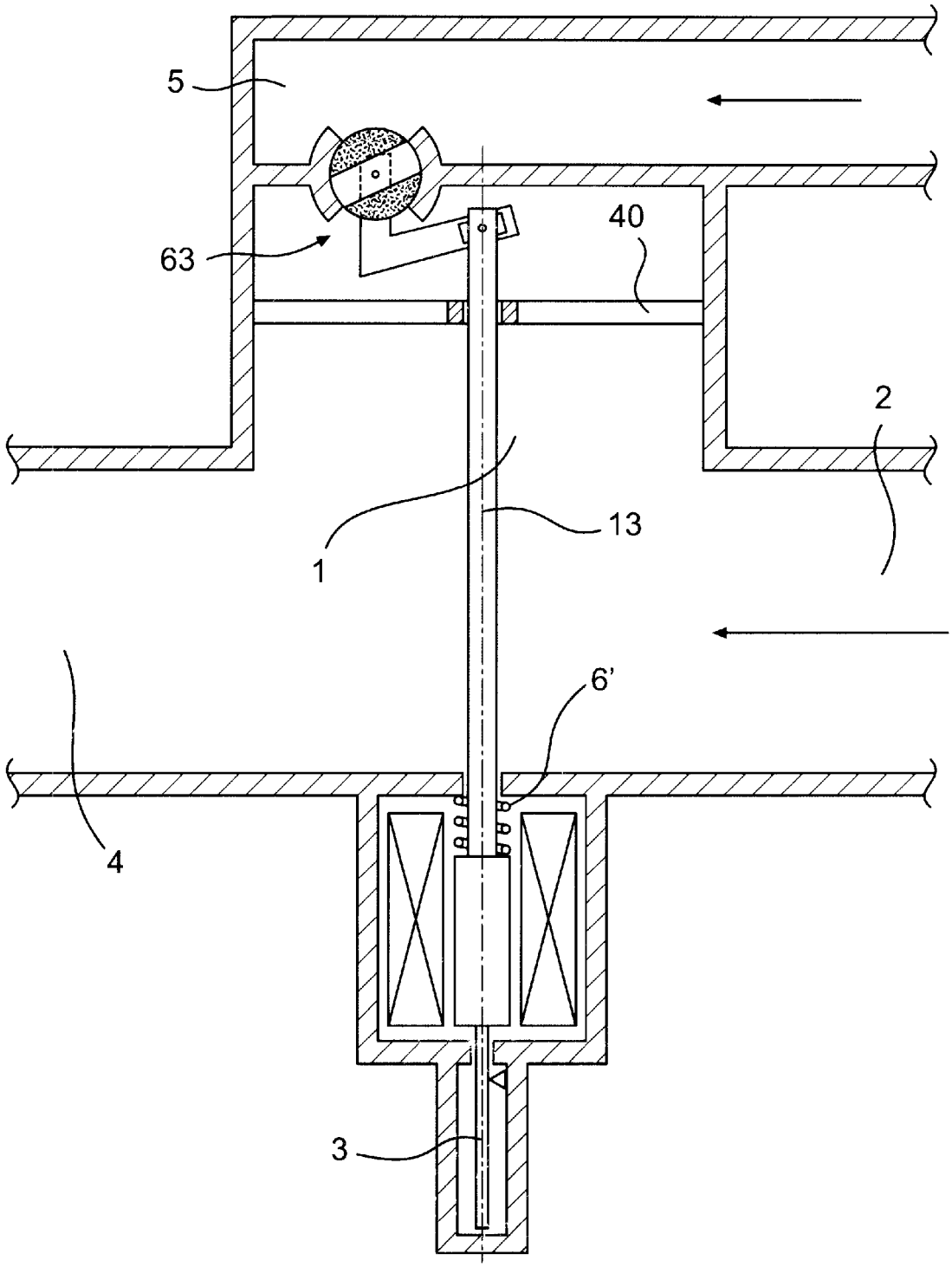
FIG. 5 shows a schematic cross-sectional representation of a further embodiment of the invention having a ball, cone or cylinder valve.

FIG. 5 shows a further embodiment of the invention similar to FIG. 3, in which a ball, cone or cylinder valve 63 is provided as main valve in order to permit the desired pressure compensation.

Figure 6:
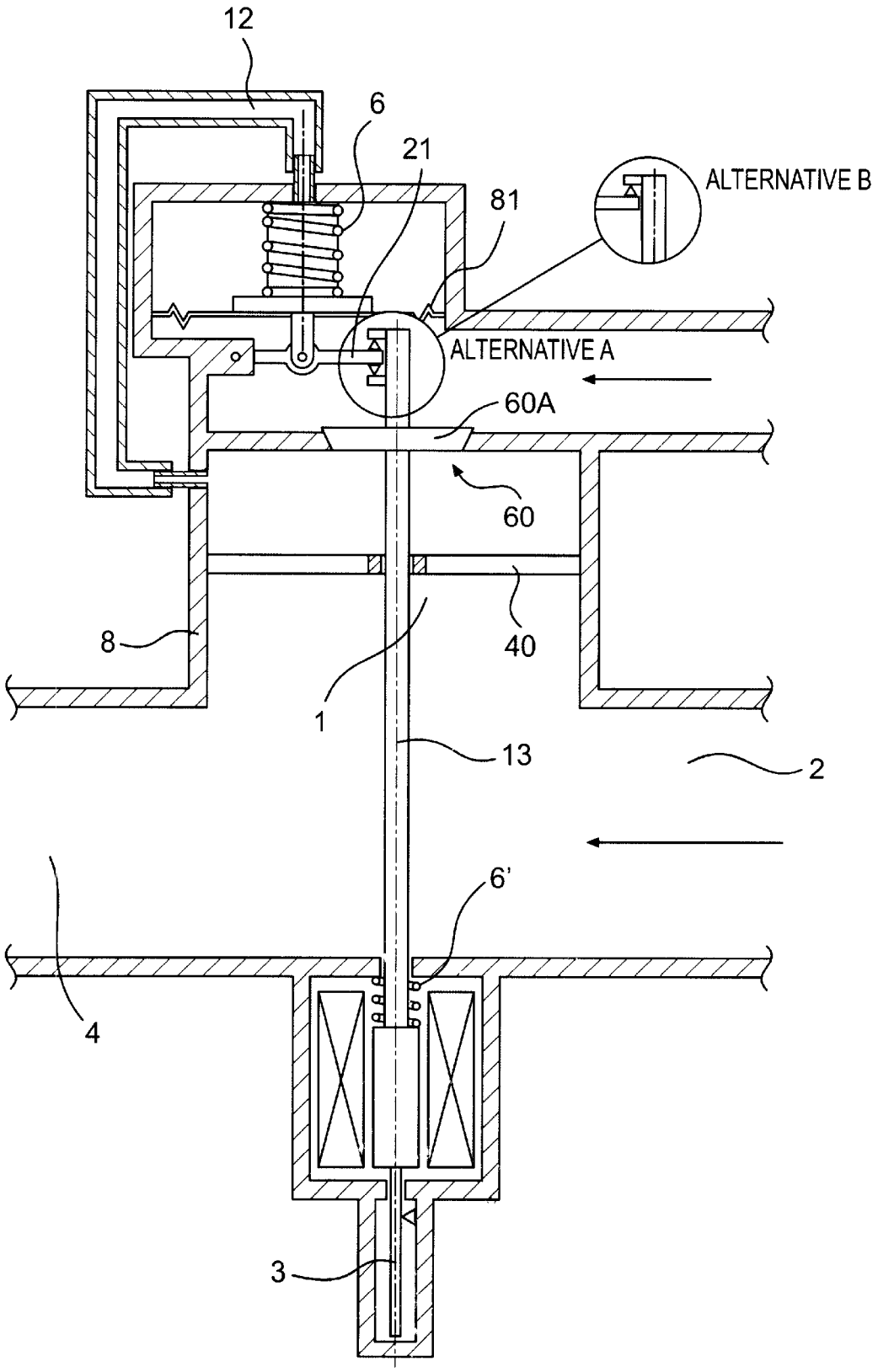
FIG. 6 shows a schematic cross-sectional representation of a further embodiment of the invention having a diaphragm and a lever transmission.

FIG. 6 shows a further embodiment of the invention which attempts to overcome the disadvantages of the embodiment described with reference to FIG. 2 and having the piston 80. In the embodiment described with reference to FIG. 2, no completely mechanically friction-free operation of the piston 80 is possible and there may still be a connection between the pressure duct 5 and the orifice 1 when the main valve 60 is closed, with the result that gas can still flow. This can be prevented by the piston 80 being replaced by a diaphragm 81 which has an effective area or cross section which is identical to or different from that of the piston 80. If the effective area $F_{81}$ of diaphragm 81 is different, for example larger, a transmission ratio or reduction ratio must be provided between the diaphragm 81 and the rod 13. Provided in the embodiment in FIG. 6 is a lever transmission having a lever arm 21 which is mounted in a pivotable manner on one side on a projection of the wall 8 and can be brought into engagement with the rod 13 on both sides (alternative A) or on one side (alternative B). The compensating force which is produced on account of the pressure gradient across the diaphragm 81 is transmitted to the rod 13 in accordance with the predetermined transmission ratio by means of a compensating arm which is connected to the diaphragm 81 on the one side and to the lever arm 21 in a pivotable manner on the other side. In the case of the engagement on one side according to alternative B, the lever arm 21 can only carry the rod 13 along in the opening direction of the main valve 60, i.e. the diaphragm 81 is uncoupled from the main valve 60 on one side. The larger force $F_{81}\times p_5$ or $F_{81}\times p_3$, respectively, is thus stepped down to the previous compensating force of the piston $F_{80}\times p_5$ or $F_{80}\times p_3$, respectively.

A corresponding embodiment having a lever transmission is also advisable in embodiments having pistons if their effective areas differ from those of the main valve. Lever kinematics are especially expedient in the case of diaphragms, which as a rule can only make relatively small strokes.

Figure 7:
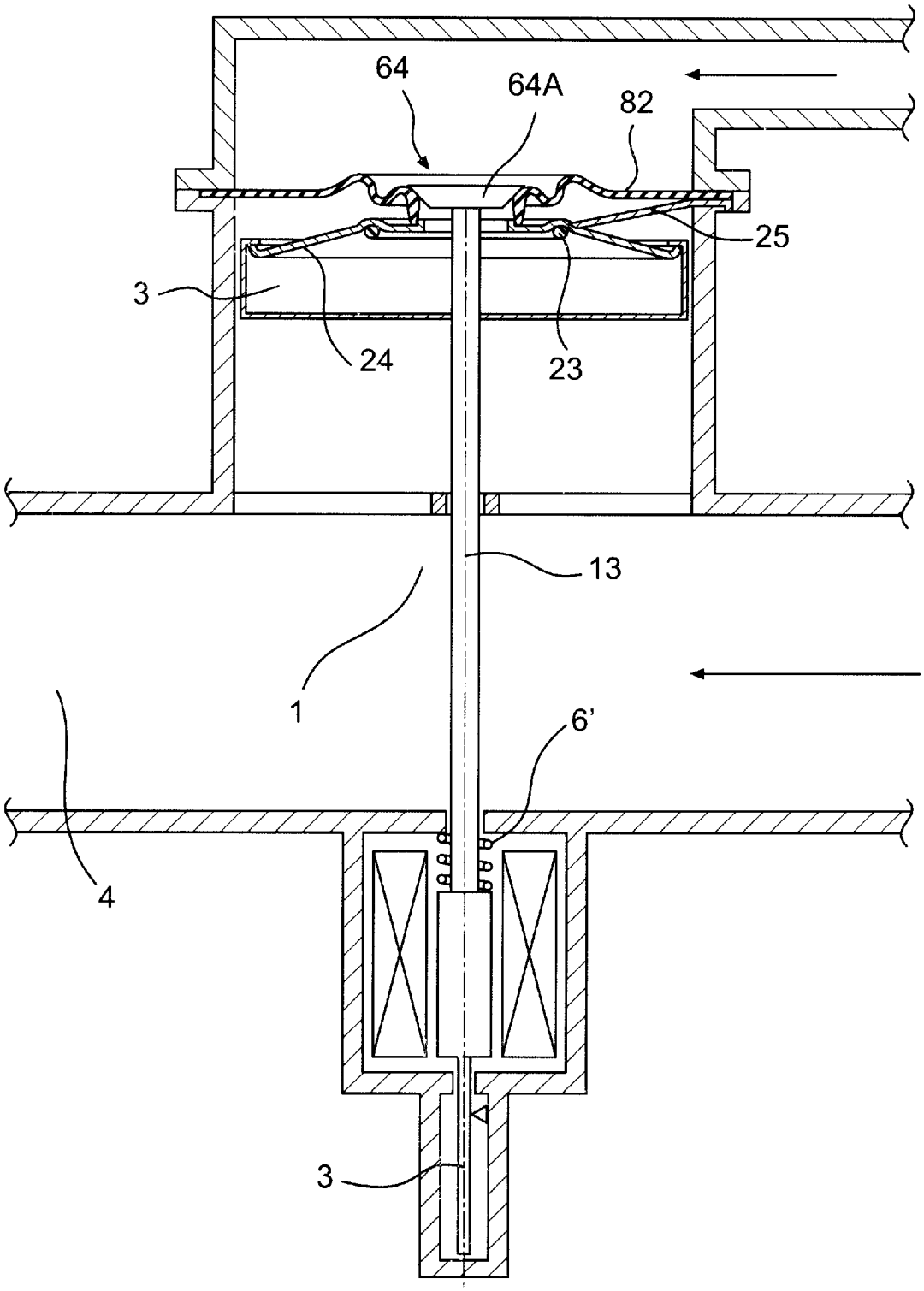
FIG. 7 shows a schematic cross-sectional representation of a further embodiment of the invention having a diaphragm and a lever transmission.
Figure 8:
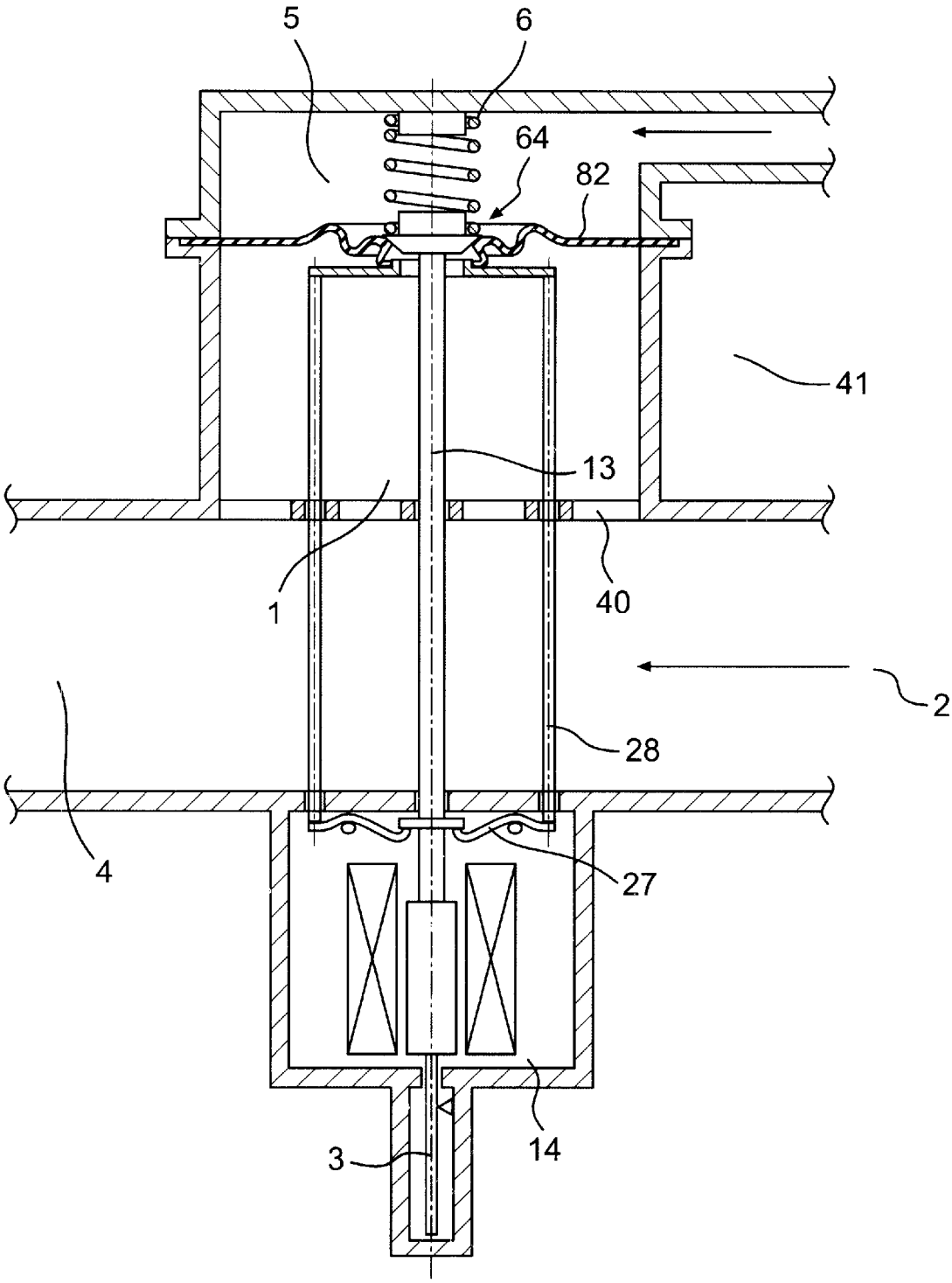
FIG. 8 shows a schematic cross-sectional representation of a further embodiment of the invention having a diaphragm and a lever transmission.

FIGS. 7 and 8 show further embodiments of the invention. Here, in order to obtain construction-space advantages and cost savings or to eliminate possible causes of damage, an embodiment is proposed which does not need the line 12 of the embodiment described with reference to FIG. 2. A diaphragm 82 which separates the pressure duct 5 from the orifice 1 is provided here at the location of the wall 60B carrying the valve seat. In this case, a valve seat of a valve disk 64A of a main valve 64 is formed in the diaphragm 82.

In the embodiment in FIG. 7, a fulcrum 23 for a lever transmission 24 is rigidly connected via a star 25 to the fixed pipelines.

In the embodiment shown in FIG. 8, the rotatably mounted levers 27 are actuated via rods 28, which, for reasons of the gas resistance in the orifice 1, expediently lie upstream of and downstream of the rod 13 in the flow direction from the fresh-gas duct 2 to the outlet duct 4. Here, on account of the contamination and corrosion risk and for temperature reasons during use as an exhaust-gas-recirculation device, the lever mechanism 27 is removed from the region which is flushed with exhaust gas. The converted compensating force is in turn transmitted to the valve disk of the main valve 64 via the rod 13 and leads to balancing of the force component to be compensated.

Figure 9:
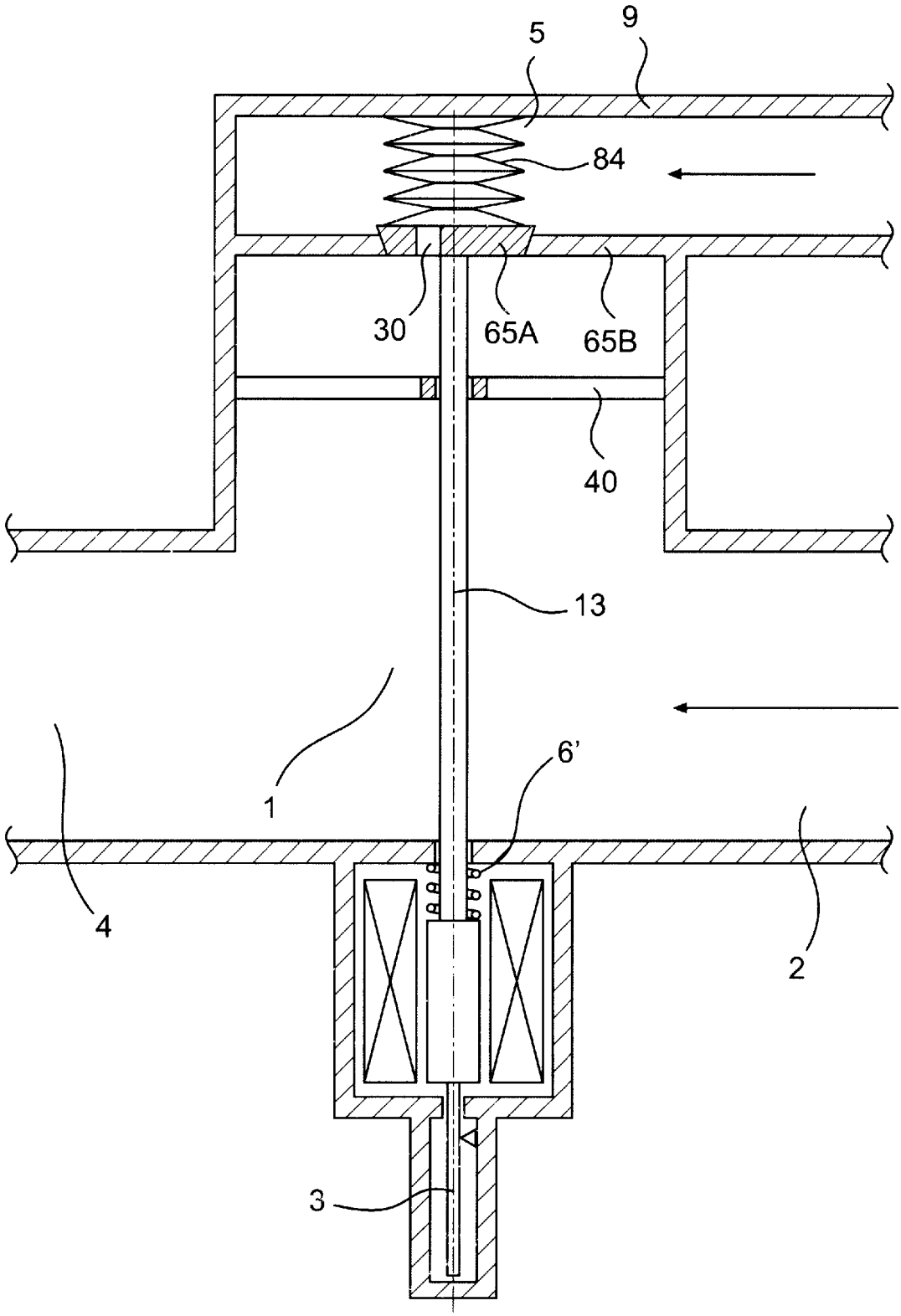
FIG. 9 shows a schematic cross-sectional representation of a further embodiment of the invention having a bellows.

FIG. 9 shows a further embodiment of the invention. In this case, a bellows 84 is provided in the pressure duct 5, this bellows 84 being connected on one side to a valve disk 65A of a main valve 65 and on its other opposite side in the longitudinal direction to the top wall 9 of the pressure duct 5. The valve disk 65A has a passage opening 30 which connects the orifice 1 to the interior space of the bellows 84 in such a way as to let gas through, as a result of which a pressure balance can form between the orifice 1 and the interior space of the bellows 84. If the pressure gradient $p_5-p_3$ or $p_3-p_2$, respectively, increases, the bellows 84 contracts in its longitudinal direction, as a result of which a force is exerted on the valve disk 65A in the opening direction of the main valve 65. The bellows 84 is to be designed in such a way that this force performs the pressure-compensating function.

Such an embodiment may be advantageous if diaphragms having sufficient diaphragm stroke (bellows) are available. For example, low friction and omission of the hysteresis can be achieved in this way; in addition, the bellows 84 can advantageously act at the same time as a closing spring of the main valve 65.

Figure 10:
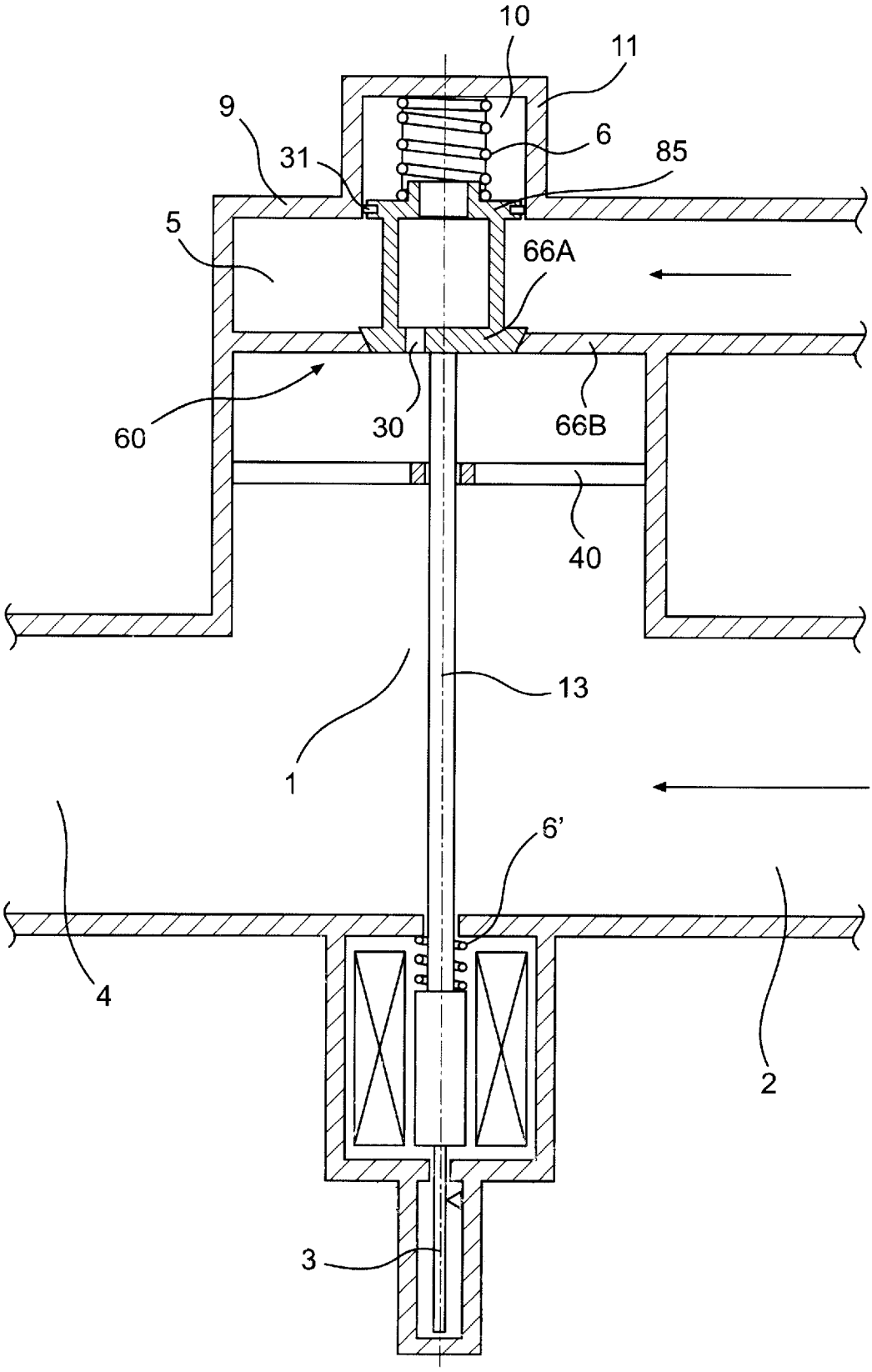
FIG. 10 shows a schematic cross-sectional representation of a further embodiment of the invention having a piston acted upon via a hollow valve body for the purpose of pressure compensation.

An embodiment on this basis, as shown in FIG. 10, is also possible with a piston 85 instead of with a bellows. A hollow valve body 66A of a main valve 66 connects, in such a way as to let gas through, the orifice 1 to the compensating space 10 which accommodates the piston 85, as a result of which it is possible to compensate for the force associated with the pressure gradient $p_5-p_3$ or $p_3-p_2$, respectively. However, the piston-specific disadvantages of the friction and the incomplete tightness again occur in this embodiment.

Figure 11:
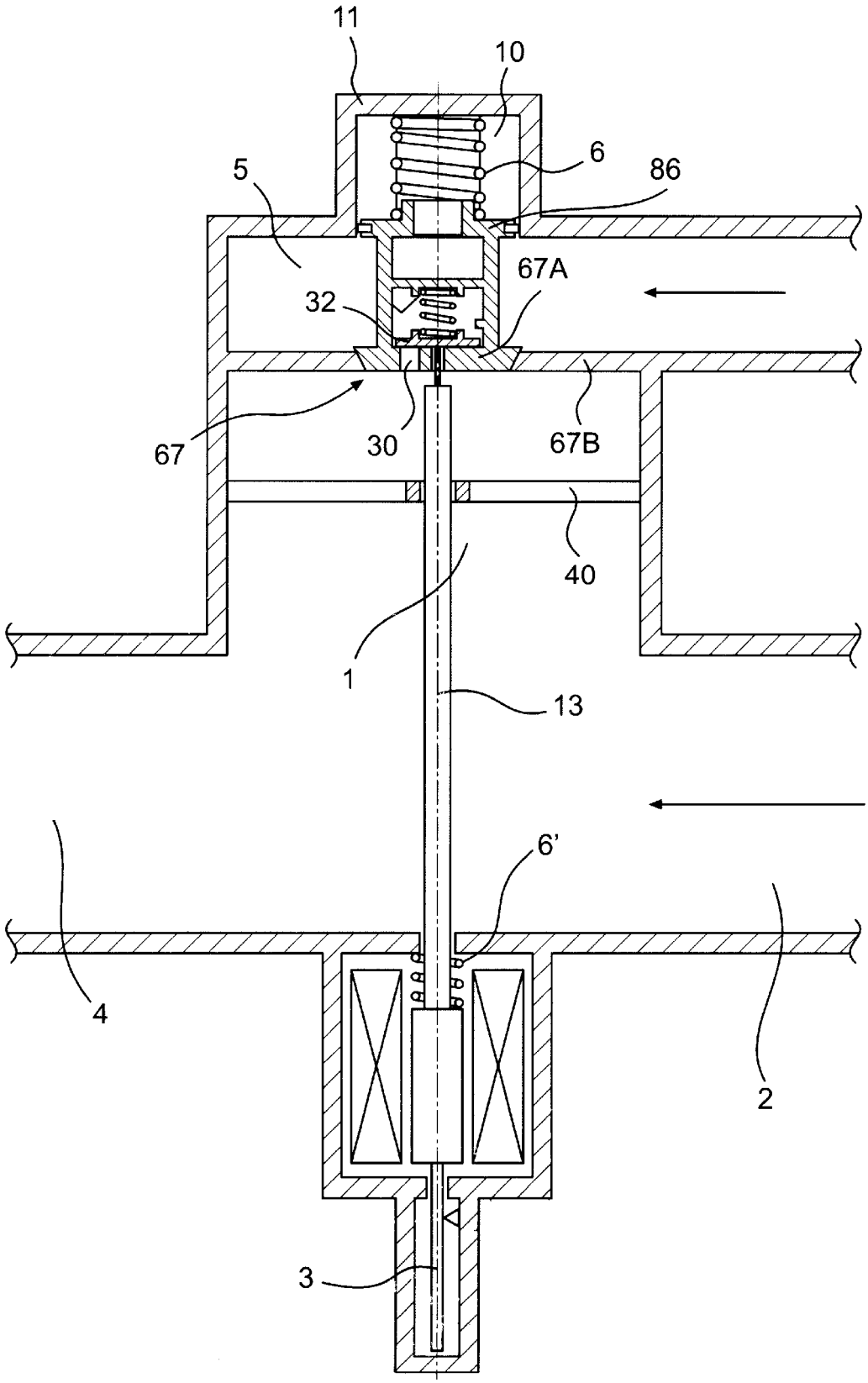
FIG. 11 shows a schematic cross-sectional representation of a further embodiment of the invention having an additional inner valve.

An embodiment in accordance with FIG. 11, in which the hermetic sealing between the pressure duct 5 and the orifice 1 is produced not by a sealing ring 31 on the piston 85 as in FIG. 10 but by an inner valve 32 inside the main valve 67, may therefore be advantageous. The inner valve 32 is opened with a preliminary stroke of the rod 13, which is caused by the actuating device, in particular by an electric magnet or proportional magnet 14. As long as the inner valve 32 is closed, the pressure gradient $p_5-p_3$ or $p_3-p_2$, respectively, keeps the inner valve 32 and thus the main valve 67 closed. If the inner valve 32 is opened by the preliminary stroke, the pressure $p_3$ or $p_2$, respectively, is obtained over the piston 86 in the compensating space 10 on account of a choke point between the outer periphery of the piston 86 and the wall 11, the cross section of which choke point has to be small compared with that of the passage opening 30 in the valve body 67A, as a result of which the pressure balance is produced. The pressure balance can be influenced by the selection of the diameter ratio of the effective area of the piston 86 to that of the valve disk 67A and by the ratios of the opening cross sections of the choke point and of the inner valve 32.

Figure 12:
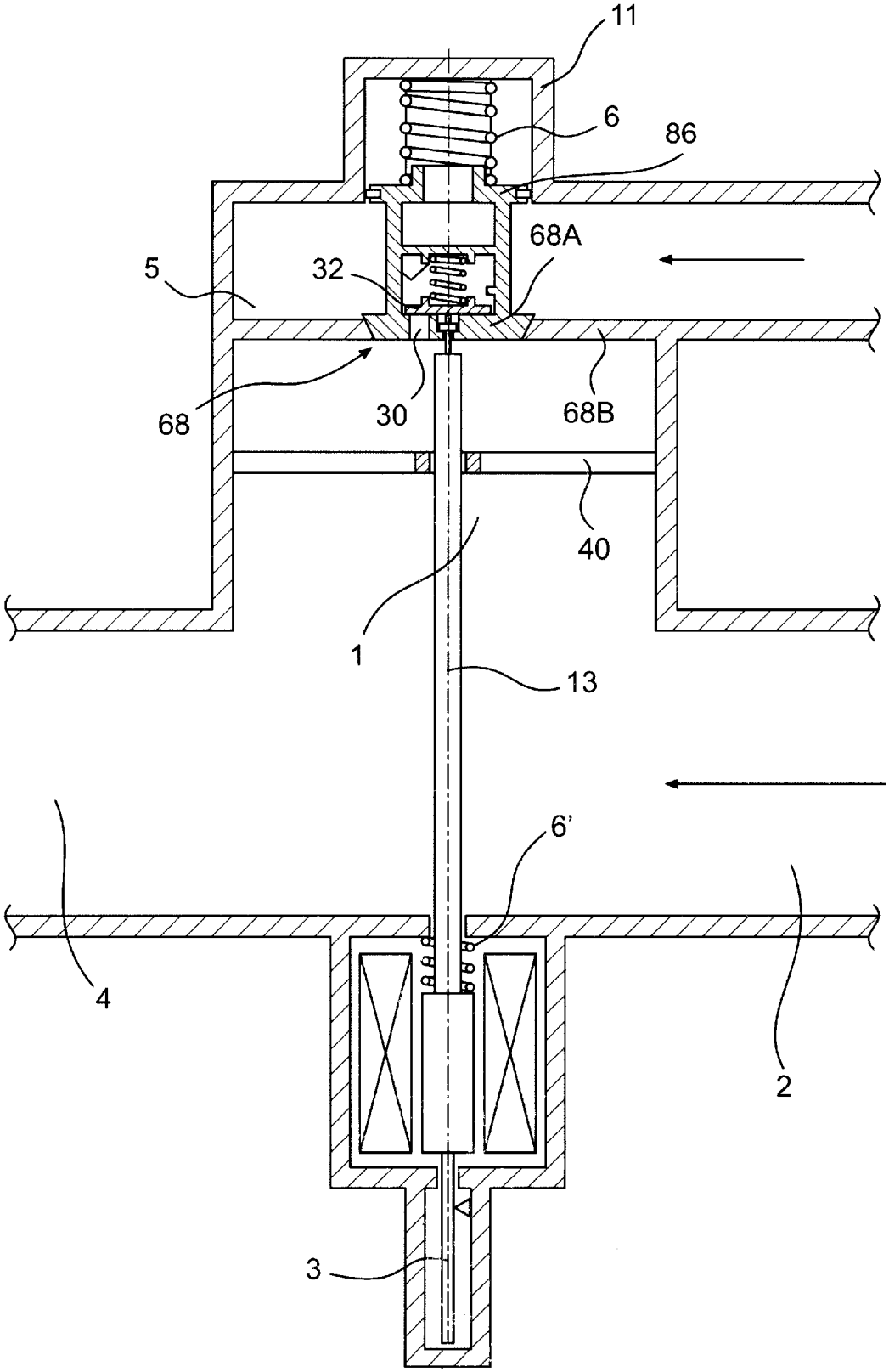
FIG. 12 shows a schematic cross-sectional representation of a further embodiment of the invention having an additional inner valve.

FIG. 12 shows a further embodiment of the gas-conducting device with pressure compensation similar to the embodiment shown in FIG. 11, with the difference that here the main valve 68 with valve disk 68A is driven in the closing direction together with an inner valve 32 not only by the spring 6 but also in a positive manner by the rod 13.

Figure 13:
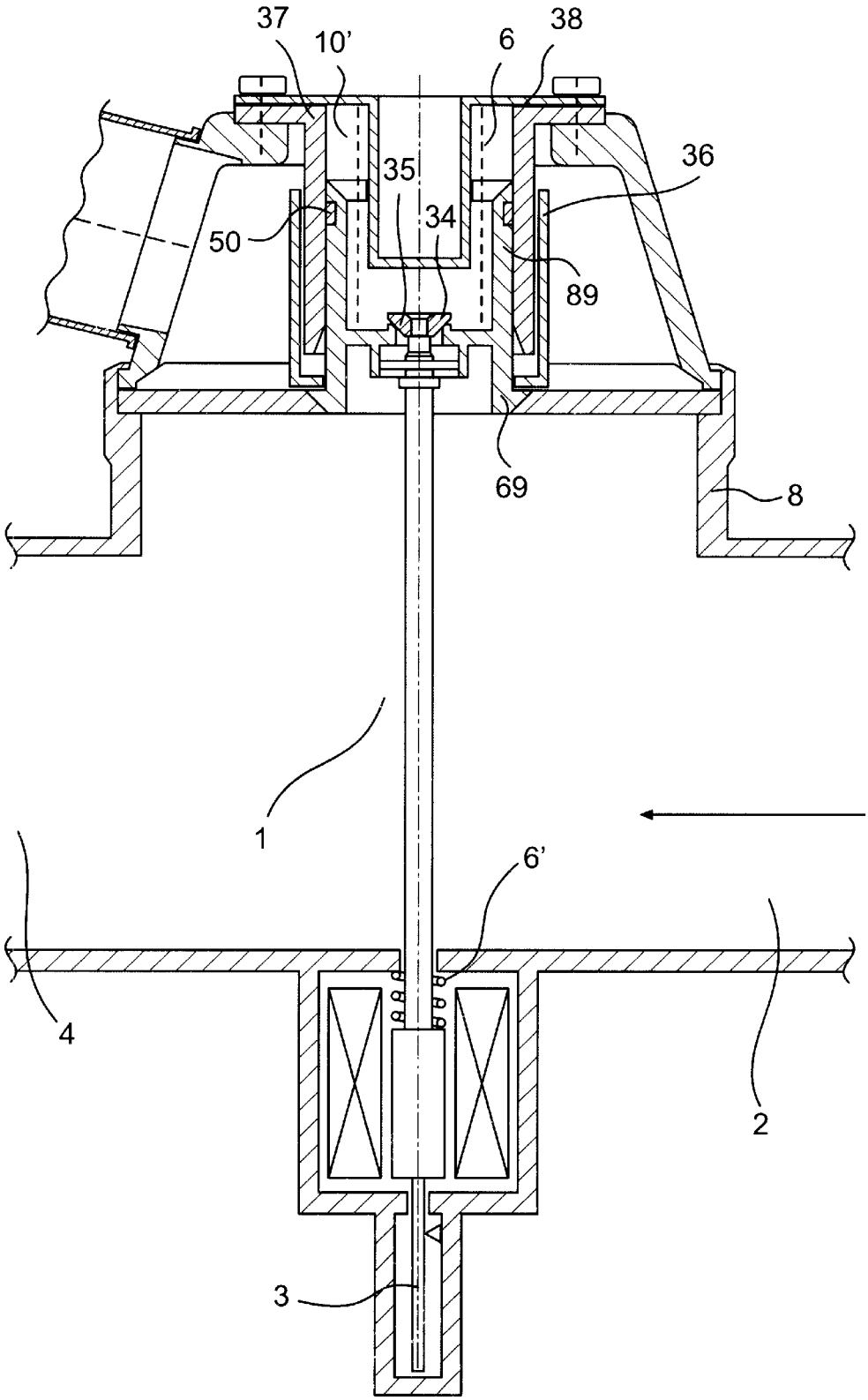
FIG. 13 shows a cross-sectional representation of a further embodiment of the invention having an additional inner valve.

FIG. 13 shows an especially preferred embodiment of the gas-conducting device with pressure compensation having an inner valve 34 which is opened during the preliminary stroke of the rod 13. In this case, the inner valve 34 has a conical or preferably hemispherical valve disk. A pin 35 fastened to the top region of the rod 13 has the task of lifting a main valve 69 after the preliminary stroke for opening the inner valve 34. Instead of such an actuation of the inner valve via the actuating device 14, an inner-valve actuating device specially provided for the actuation of the inner valve may alternatively also be provided, this inner-valve actuating device permitting the independent actuation (not shown) of main valve and inner valve.

In order to ensure a reliable sliding fit, the surfaces of the piston 89 and of a guide sleeve 37 should be matched to one another (e.g. steel/bearing metal, etc.).

A protective sleeve or sleeve 36 which protects the sliding fit of the piston 89 in the guide sleeve 37 against contamination may be optionally provided. A lid 38 is designed such that, or is provided with a separate filling piece such that, a space above the main valve 69, this space constituting an inner-valve compensating space 10', is kept as small as possible, so that the respectively desired pressure ($p_5$ or $p_3$, respectively, in the closed state and $p_3$ or $p_2$, respectively, in the open state) forms as quickly as possible and as little gas as possible can enter this inner-valve compensating space 10'. The gas pressure in the inner-valve compensating space is designated by $p_{10}'$. If it is advantageous for the matching and/or to prevent contamination, a sealing ring 50 which produces a partial gas seal of an opening gap between the piston 89 and the guide sleeve 37 may be used. In order to facilitate the insertion of the piston 89 into the guide sleeve 37, the latter has been given a bevel on its inside diameter at its bottom end.

The rod 13, in addition to being guided at the top by the wall star 40 (FIGS. 2, 3, etc.) or similar devices, may also be guided at the top by the pin 35, a diaphragm or a bellows.

Depending on the matching of the diameter ratios of the pistons and diaphragms or bellows 80–89 to the respective main valves 60–69, during exhaust-gas recirculation and at pressures $p_3>p_5$, which may occur, for example, during a positive flushing gradient caused by a turbocharger or in the case of mechanical supercharging of an engine, the valves 60, 64, 65, 66, 67, 68, 69 may open, which would lead to charge-air losses. One possibility of counteracting this consists in reversing the polarity of the magnet when using a permanent magnet as armature, or a corresponding measure if an electromotive, pneumatic, hydraulic or mechanical actuation of the inner valves is provided as actuating device.

Another possibility, in the embodiments shown in FIGS. 11 to 13, consists in simply opening the inner valve 32 or 34, respectively, via the magnet or the corresponding actuating device at such operating points. The pressure $p_3$, which is higher than $p_5$, would then be applied below the main valve 67 to 69 in the orifice 1 and above the piston 86 or 89, respectively, so that the main valve 67 to 69 could be closed by a spring for example. The slight charge-air loss via a choke point between guide sleeve 11 or 37 and piston 86 or 89, respectively, can be tolerated.

Figure 14:
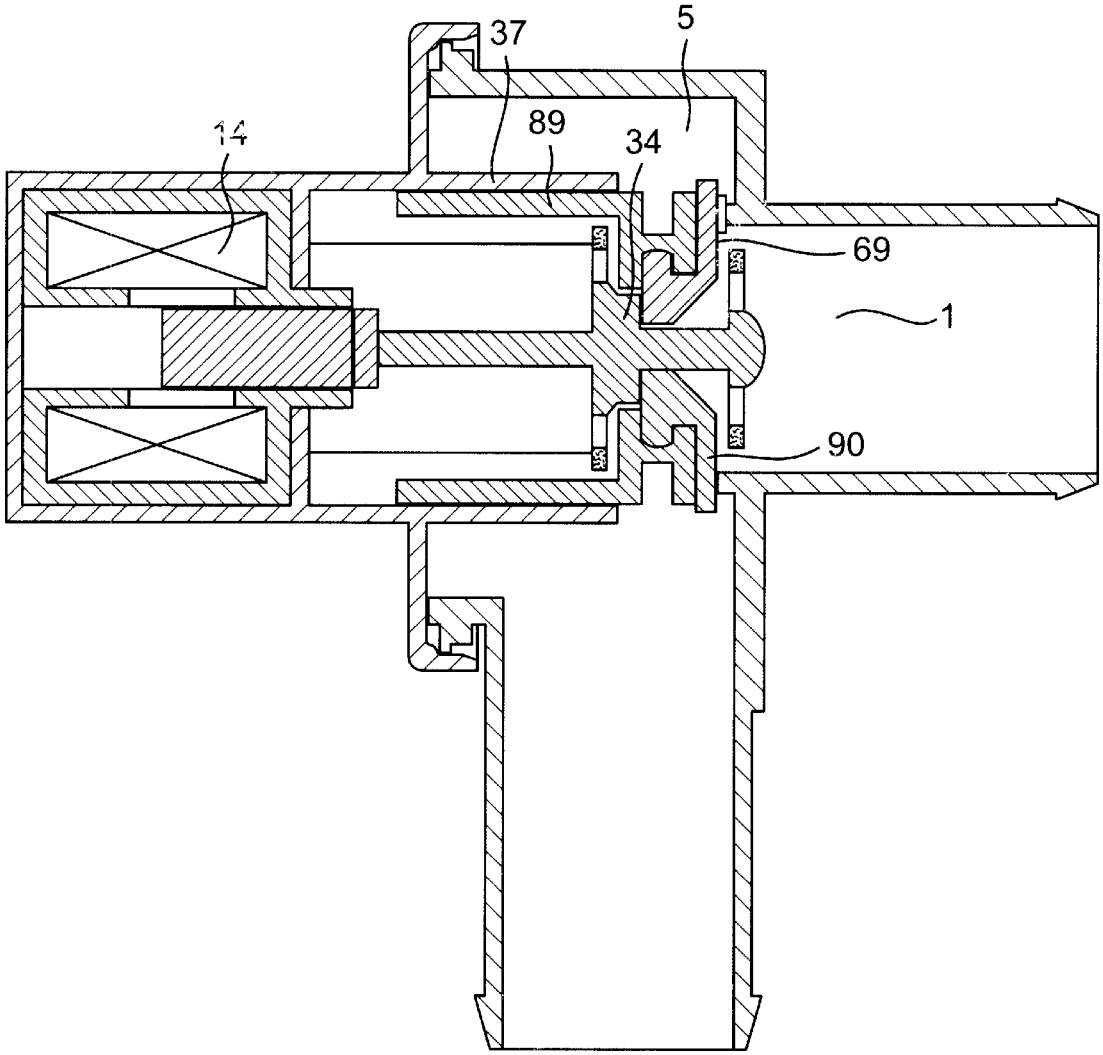
FIG. 14 shows a schematic cross-sectional representation of an embodiment of the invention preferred for the air-conducting means.
Figure 15:
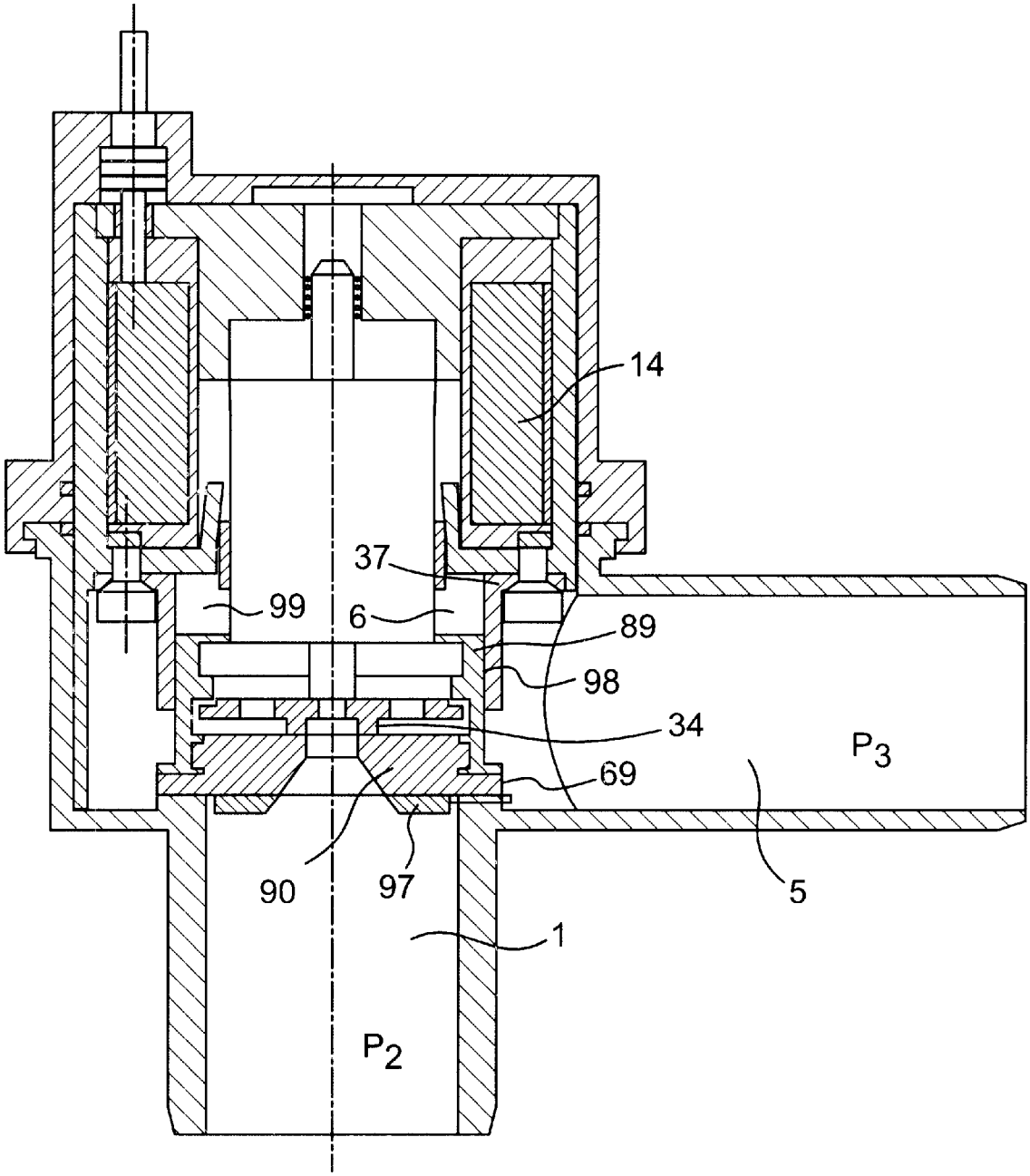
FIG. 15 shows a cross-sectional representation of a further embodiment of the invention preferred for the air-conducting means.

FIGS. 14 and 15 show embodiments of the invention which are especially suitable for the air-conducting device b according to the invention in FIG. 1 and therefore differ in substantial design features from the embodiments shown in FIGS. 2 to 13. Those design features which correspond to or are similar to the preceding embodiments are provided with the same reference numerals and they are not described again in this case.

Since, with this use, gas flows through the valve at a temperature which cannot jeopardize the magnet 14, the latter may be arranged on the inflow side of the valve, which results in important advantages with regard to construction space, weight and costs of the valve. In addition, at least one side of each of the valve seats of the valves 34 and 69 may be made of an elastomer. This can preferably consist of a single component 90 for both valves.

It is especially advantageous in this embodiment to use a push-type magnet instead of a pull-type magnet.

Since the object of this embodiment of the valve is not to meter one gas in order to admix it with another gas, but rather the concern here is to provide a large outflow section as far as possible without delay and to also close this outflow section again likewise as far as possible without delay, a complicated proportional magnet is not required. The magnet, in the closed state of the valve, merely needs to provide the force in order to open first of all the inner valve 34 against the mass actions, against gas pressure, against an inner spring 99 and against a possible adhesion effect of the elastomer and then the main valve 69 against the now larger masses, the inner spring 99, the outer spring 6 and the possible adhesion effect of the elastomer. The magnetic force may decrease after the adhesion effect has been overcome.

Since this embodiment of the valve recognizes essentially only the positions "ON" and "OFF", all of the design measures which permit large cross sections for both the inner and the outer valve are appropriate. Thus in FIG. 15 the valve 34 is no longer restricted in its cross section by the rod passing through. Further advantages in FIG. 15 are the smaller masses of the moving parts and the more accurate definition of the maximum preliminary stroke for opening the valve 34 by virtue of the fact that this preliminary stroke is no longer limited by contact between, for example, metal and elastomer.

Since the inner spring 99 in FIG. 15 closes both the inner valve 34 and the outer valve 69, the outer spring 6 may also be dispensed with if the spring 99 is suitably dimensioned.

The valve according to FIG. 15 is thus preferably used at the location b in FIG. 1. In the closed state, the pressure $P_3$, which as a rule is the higher pressure, is applied via a choke point 98 to the piston 89 and thus also to the valves 34 and 69 and therefore provides for their hermetic tightness.

If the blowing-off command is now given, the magnet 14 in the preferred embodiment in FIG. 15 only has to overcome the spring 99, the adhesion effect of the elastomer, the gas force resulting from the pressure difference $(P_3-P_2)\times$ effective area of the inner valve 34, and the mass actions. It is therefore advisable here to keep the cross section of valve 34 small in order to keep the magnet small.

After valve 34 has been opened, since the cross section of valve 34 is always large compared with the cross section of the choke point 98, a pressure balance is effected between the space above the piston 89 and the line 1, so that the pressure $P_2$ prevails in both cases. The main valve 69 can thus now be opened by the magnet 14 against the spring 99, the adhesion effect in the valve seat of valve 69 and the larger mass actions of the main valve. Forces resulting from pressure differences need no longer be overcome. If the closing command is given, that is for the case that $P_3$ is to be increased relative to $P_2$ by the supercharger, the current in the magnet 14 is switched off or its polarity is even reversed. If the current is switched off, the spring 99 now has to first of all close the valve 34 and thus then also the valve 69. This is effected against the residual magnetism and against the mass action of both valves.

If the polarity is reversed, the magnet 14 could assist the spring 99. With appropriate magnetic properties of the armature of magnet 14, such an effect could even be intensified.

As soon as the cross section of valve 69 in particular is reduced and the pressure $P_3$ also begins to build up above the piston 89, the pressure difference $(P_3\times P_2)\times$effective piston cross section naturally helps the spring 99 during the closing work and builds up the maximum closing force corresponding to the valve cross section.

For primarily acoustic reasons, it may be appropriate to provide for a slow start to the opening of the valve cross section 69, which slow start should then change to rapid complete opening. This can be achieved by controlling the current of the magnet 14. However, it may also be achieved or assisted by suitable configuration of the diameter ratios of the valve 34 to the valve 69. In both cases, a relatively large or especially large valve cross section of the valve 34 is advisable, an aim which conflicts with that of using as small a magnet 14 as possible.

The acoustic aims may also be achieved in particular by suitable configuration of the valve cross section of the valve 69 in the stroke region of the opening phase, e.g. by suitable aerodynamic shaping or by the valve being provided with a suitable choke collar 97.

What is claimed is:

1. An air-conducting device for internal combustion engines having a charge-air device, said air-conducting device comprising:

a fresh-air pressure duct which opens into a compressor outlet duct of a compressor of the charge-air device, a fresh-air duct feeding fresh air;

a compressor inlet duct;

an orifice opening into the fresh-air duct and the compressor inlet duct;

at least the fresh-air pressure duct and the orifice being connected to one another via a control element for metering air; and a compensating device being provided in order to compensate for forces which act on the control element on account of a pressure difference between gas a pressure ($p_3$) at a pressure-gas side and a gas pressure ($p_2$) at a fresh-gas side in such a way that the pressure difference does not lead to a force component which acts in the direction of opening or closing of the control element, wherein the gas pressure ($p_3$) is defined at the fresh-air pressure duct and wherein the gas pressure ($p_2$) is defined at the orifice.

2. The air-conducting device as claimed in claim 1, one side of the compensating device being acted upon by the gas pressure ($p_3$) on the pressure-gas side and the other side being acted upon by the gas pressure ($p_2$) on the fresh-gas side.

3. The air-conducting device as claimed in claim 1 or 2, wherein the compensating device includes in the control element one of the group consisting of a butterfly valve, a double disk valve, a ball valve, a cone valve and a cylinder valve.

4. The air-conducting device as claimed in claim 1 or 2, the control element comprising a valve rod and a valve disk secured thereto and having a gas-pressure-effective area, so that a valve-disk force acts on the valve disk, the valve-disk force being equal to the product of the gas-pressure-effective area and the pressure difference, and the compensating device including one of the group consisting of a piston, a diaphragm and a bellows, which is secured to the valve rod and which has a gas-pressure-effective area on which the pressure difference ($p_3-p_2$) acts, so that a compensating force which compensates for the valve-disk force acts on the valve rod.

5. The air-conducting device as claimed in claim 1 or 2, the control element being actuable by one of the group consisting of a mechanical actuating device, a pneumatic actuating device, a hydraulic actuating device, a magnetic actuating device and an electric actuating device.

6. The air-conducting device as claimed in claim 1, the compensating device comprising an inner valve which is provided in the control element.

7. The air-conducting device as claimed in claim 6, wherein the inner valve is disposed operatively between (a) one of the pressure-gas side and the fresh-gas side and (b) a compensating space defined on the other of the pressure-gas side and the fresh-gas side and isolated therefrom, wherein a gas pressure is defined within the compensating space, and wherein actuation of the inner valve controls the compensating space gas pressure.

8. The air-conducting device as claimed in claim 1 or 2, wherein the compensating device defines a surface having a first gas-pressure-effective area, wherein the control element defines a surface having a second gas-pressure-effective area, wherein one of the first gas-pressure-effective area and the second gas-pressure-effective area is greater than the other, and wherein the compensating device includes a kinematic transmission between the compensating device surface and the control element that offsets a pressure difference resulting from the difference between the first and second gas-pressure-effective areas.

9. The air-conducting device as claimed in claim 1, wherein the control element is biased in the closing direction.

10. The air-conducting device as claimed in claim 2, including an actuating member and wherein the compensating device and the control element are connected to one another and so that the actuating member actuates both the compensating device and the control element.

11. The air-conducting device as in claim 1, including an electromagnet in operative communication with the control element to actuate the control element between open and closed positions.

12. The air-conducting device as in claim 7, wherein the compensating device includes a piston and a piston guide sleeve, wherein the piston and the piston guide sleeve define a gap there between, and wherein activation of the inner valve controls the compensating space gas pressure through the gap.

13. The air-conducting device as in claim 7, including an actuating member that actuates both the compensating device and the inner valve.

14. The air-conducting device as in claim 7, including an actuating member that actuates only the inner valve.

15. The air-conducting device as in claim 1, wherein the compensating device defines a surface having a first gas-pressure effective area, wherein the control element defines a surface having a second gas-pressure-effective area, wherein one of the first gas-pressure-effective area and the second gas-pressure-effective area is greater than the other, and wherein the compensating device includes a lever between the compensating device surface and the control element that offsets a pressure difference resulting from the difference between the first and second gas-pressure-effective areas.

16. The air-conducting device as claimed in claim 9, including a diaphragm that biases the control element in the closing direction.

17. The air-conducting device as claimed in claim 9, including a bellows that biases the control element in the closing direction.

18. The air-conducting device as claimed in claim 9, including a spring that biases the control element in the closing direction.

19. An air-conducting device for internal combustion engines having a charge-air device with a compressor, a compressor inlet duct and a compressor outlet duct, said air-conducting device comprising:

at a pressure-gas side, a fresh-air pressure duct which opens into the compressor outlet duct;

at a fresh-gas side, a fresh-air duct feeding fresh air;

an orifice opening into the fresh-air duct and the compressor inlet duct;

a control element between the fresh-air pressure duct and the orifice that meters air between the pressure-gas side and the fresh-air side; and a compensating device in communication with the pressure-gas side, the fresh-gas side and the control element so that a pressure difference between the pressure-gas side and the fresh-gas side across the compensating device counterbalances a pressure difference between the pressure-gas side and the fresh-gas side across the control element in the control element's opening or closing direction.

20. The air-conducting device as in claim 19, wherein the control element includes a butterfly valve and wherein the compensating device includes the same butterfly valve.

21. The air-conducting device as in claim 19, wherein the control element comprises a valve rod, and a valve disk secured to the valve rod and having a gas-pressure-effective area so that a valve disk force acting on the valve disk is equal to the product of the gas-pressure-effective area and the pressure difference across the control element, and wherein the compensating device defines a biasing area which is secured to the valve rod and which has a gas-pressure-effective area on which the pressure difference across the compensating device acts, so that a compensating force which compensates for the valve-disk force acts on the valve rod.

22. The air-conducting device as in claim 19, wherein the compensating device includes a valve disposed operatively between (a) one of the pressure-gas side and the fresh-gas side and (b) a compensating space defined on the other of the pressure-gas side and the fresh-gas side and isolated therefrom, wherein a gas pressure is defined within the compensating space, and wherein actuation of the valve controls the compensating space gas pressure.

* * * * *